US006464377B2

(12) United States Patent
Splane, Jr.

(10) Patent No.: US 6,464,377 B2
(45) **Date of Patent: *Oct. 15, 2002**

(54) DUAL REFLECTOR LIGHTING SYSTEM

(75) Inventor: Robson L Splane, Jr., Granada Hills, CA (US)

(73) Assignee: Stingray Lighting, Inc., Escondido, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/918,122

(22) Filed: Jul. 30, 2001

(65) Prior Publication Data

US 2002/0015307 A1 Feb. 7, 2002

Related U.S. Application Data

(62) Division of application No. 09/126,061, filed on Jul. 30, 1998, now Pat. No. 6,273,590, which is a division of application No. 08/843,889, filed on Apr. 17, 1997, now Pat. No. 5,791,768.

(51) Int. Cl.[7] ..... F21V 7/00
(52) U.S. Cl. ..... 362/296; 362/319; 362/350
(58) Field of Search ..... 362/147, 148, 362/150, 277, 296, 319, 350

(56) References Cited

U.S. PATENT DOCUMENTS 5,582,479 A * 12/1996 Thomas et al. ..... 362/277
5,738,436 A * 4/1998 Cummings et al. ..... 362/294
5,791,768 A * 8/1998 Splane, Jr. ..... 362/280

* cited by examiner

*Primary Examiner*—Mark A. Robinson
(74) *Attorney, Agent, or Firm*—Fitch, Even, Tabin, & Flannery

(57) ABSTRACT

A dual reflector lighting system having an adjusting assembly for independently adjusting an inner reflector and an outer reflector relative to a gaseous discharge lamp. The lighting system includes a housing having a ballast assembly mounted therein. An elongated tubular adjusting member has one end thereof connected to the bottom of the housing. A lamp socket for receiving a gaseous discharge lamp is mounted to the other end of the adjusting member. The lamp socket is electrically connected to the ballast assembly. The system includes both an outer reflector and an inner reflector mounted coaxially about the gaseous discharge lamp. The outer reflector is mounted to the tubular adjusting member for movement relative thereto to adjust the outer reflector relative to the gaseous discharge lamp. The inner reflector is connected to the adjusting member for adjusting the inner reflector relative to the gaseous discharge lamp. The invention also covers a dual reflector assembly including an outer reflector, an inner reflector and an adjusting assembly which is adapted to be mounted to the housing of a gaseous discharge lamp fixture. The invention also covers a retrofit kit which includes an outer reflector, an inner reflector, a lamp socket and a adjusting assembly for adjusting the inner reflector and outer reflector relative to the lamp of a fixture. The retrofit kit may also include a reduced wattage ballast and a gaseous discharge lamp.

14 Claims, 3 Drawing Sheets

DUAL REFLECTOR LIGHTING SYSTEM

This application is a divisional of U.S. application Ser. No. 09/126,061, filed Jul. 30, 1998, now U.S. Pat. No. 6,273,590, which was filed as a divisional of Ser. No. 08/843,889, filed Apr. 17, 1997, now U.S. Pat. No. 5,791,768.

BACKGROUND OF THE INVENTION

1. Field of the Invention

This invention relates to a dual reflector lighting system or luminaire having an outer reflector and an inner reflector and an adjusting assembly for independently adjusting each of the inner and outer reflectors. The use of the dual reflector system increases the efficiency of the fixture such that 250 watt fixtures can replace 400 watt fixtures without any loss of light at the working plane. This results in a substantial energy saving. The subject invention allows the inner and outer reflectors to be adjusted independently of each other, which gives great versatility to the fixture to allow it to be used in many applications of varying heights and spacings and achieve optimum results. The inner reflector and outer reflector are mounted concentrically and are adjusted in such a way as to prevent cocking and to maintain concentricity. The invention also includes the adjusting assembly for independently adjusting an outer reflector and an inner reflector relative to a high intensity discharge lamp. The adjusting assembly includes an elongated adjusting member having one end mounted to the outer reflector and the other end mounted to the casing or housing for the ballast. Facilities are provided for adjusting the inner reflector relative to the adjusting member. Facilities are also provided to adjust the outer reflector relative to the adjusting member. The invention also covers a dual reflector assembly including an inner and an outer reflector and an adjusting assembly for allowing independent adjustment of each reflector relative to the adjusting assembly. The invention also covers a retrofit kit for retrofitting conventional fixtures to become dual reflector fixtures.

2. Description of Related Art

Thomas et al. U.S. Pat. No. 5,582,479 discloses a dual reflector lighting system having an outer reflector and an inner reflector. The inner and outer reflectors are adjustable relative to each other by a plurality of screws. The outer reflector is adjustable by a bracket, but movement of the outer reflector also moves the inner reflector. An alternative embodiment discloses a bracket assembly for the inner reflector which is adjustable about the lamp socket. In view of the fact that the subject invention is an improvement of this patent, all of this patent is incorporated herein by reference.

Henderson Jr., et al U.S. Pat. No. 4,173,037 discloses a luminaire lamp support device in which the lamp socket is adjustably mounted on a bracket for adjustment of the socket along a substantially vertical axis. This enables adjustment of the lamp to different positions to obtain various light distribution patterns. The lamp has an outer reflector and an asymmetric inner reflector which is mounted for rotational adjustment about the vertical axis of the luminaire for producing asymmetric distribution of reflected light.

Sholtz U.S. Pat. No. 5,178,452 discloses an operating theater lamp with a outer reflector which illuminates the area of operation and an auxiliary reflector having an outer diameter which corresponds approximately to the inner diameter of the outer reflector and which is arranged inside the outer reflector to deflect a part of the light beam at a steeper or narrow angle into the bottom of a surgical wound.

Wijbenga, et al U.S. Pat. No. 5,251,116 discloses a luminaire for creating a primary beam and a secondary beam.

Baldwin, et al U.S. Pat. No. 4,943,901 discloses a luminaire with auxiliary reflecting means for reflecting light passing through the top opening and for reflecting such light to illuminate stacked material along the edges of the aisle.

Compton U.S. Pat. No. 4,231,080 discloses a luminaire having at least three stack reflector members.

Cochran U.S. Pat. No. 1,286,535 discloses a lighting fixture having a outer reflector and a stationary auxiliary reflector.

None of the foregoing prior art have suggested a lighting fixture having an inner reflector and an outer reflector and an adjusting mechanism that allows for the adjustment of both the outer reflector and the inner reflector independently of each other.

SUMMARY OF THE INVENTION

The present invention fills a need for an energy efficient high bay lighting fixture or luminaire which enables fixtures having lamps of reduced wattage to be used to replace higher wattage fixtures thereby conserving significant amounts of energy. Typically, the replacement of a 400 watt luminaire with a 250 watt luminaire will result in an approximately 40% or greater savings in energy. The present invention relates to a luminaire having a high intensity or gaseous discharge lamp which is mounted with the base up or down in a substantially vertical position. An inner reflector is mounted to an adjusting assembly for coaxial movement relative to the lamp. The inner reflector is adjustable along the longitudinal axis of the lamp so that a substantial amount of light is reflected from the inner reflector onto a first predetermined area while a smaller amount of light is reflected from the outer reflector onto a second predetermined area outside of the first area. The first predetermined area is an area substantially larger than the outer diameter of the outer reflector. It is typically an area that is equal to or greater than the width of an aisle and usually averages fifteen to thirty feet in diameter.

In one embodiment of this invention, a threaded elongated adjusting member having at least two and preferably three equidistant longitudinal grooves formed therein has one end attached to the casing of a high intensity discharge fixture. The casing contains the ballast assembly which includes a ballast, capacitors, and ignitors if required, as is well known within the art. The adjusting member has a hollow portion in the bottom into which a lamp socket is secured. Preferably, the lamp socket is fully recessed within the adjusting member. The wires from the lamp socket run through the adjusting member and are connected to the ballast in the casing. An outer reflector having a threaded adjusting ring or member connected to the top thereof with threads complementary to those of the adjusting member is mounted to the lower end of the adjusting member. The outer reflector can be adjusted to any desired position on the adjusting member by rotation of the adjusting ring. A plurality of elongated members or rods which fit into the grooves of the adjusting member have their lower ends connected to an inner reflector. The upper ends of the rods are offset or flanged to engage the upper surface of another threaded adjusting ring which, upon rotation, moves the rods up and down in the grooves along the length of the adjusting member.

In another embodiment of this invention, a dual reflector adjusting assembly is provided which includes a smooth adjusting member with a plurality of equidistant longitudinal grooves, preferably three, formed therein. A first clamp, which is connected to the top of the outer reflector, is adapted to move about and clamp on the lower end of the adjusting member to position the outer reflector at a desired location. A plurality of rods which ride in the grooves of the adjusting member have their lower ends connected to an inner reflector. A second clamp is adapted to move about the adjusting member and engage the upper ends of the rods. When the desired position of the inner reflector is obtained, the clamp is secured to the adjusting member to lock in the position of the inner reflector.

In another embodiment of this invention, a tubular adjusting assembly has a smooth adjusting member without any grooves formed therein. A first clamp is mounted to the outer reflector and is adapted to move along the adjusting member and be secured at a desired position for setting the outer reflector. A second clamp has a plurality of rods fixed thereto, the lower ends of which are connected to the inner reflector, and the upper ends of which are connected to the second clamp. This second clamp is moved and positioned along the adjusting member for adjustment of the inner reflector.

Further aspects of the present invention will become apparent from the following detailed description when considered in conjunction with the accompanying drawings. It should be understood, however, that the detailed description and the specific examples while representing the preferred embodiments are given by way of illustration only.

DETAILED DESCRIPTION OF THE PREFERRED EMBODIMENTS

The following description is of the best presently contemplated modes of carrying out the inventions. This description is made for the purpose of illustrating the general principles of the invention and should not be taken in a limiting sense.

Figure 1:
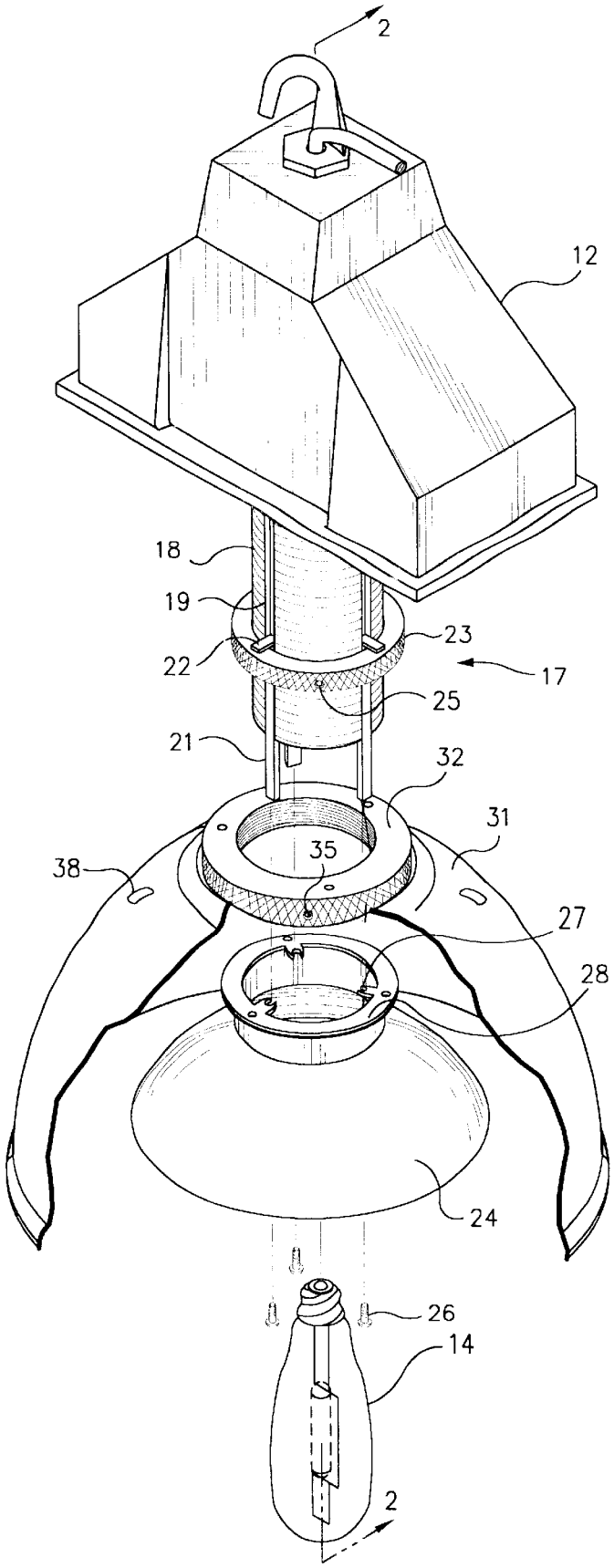
FIG. 1 is a partially exploded perspective view of a luminaire in accordance with this invention with the outer reflector partially broken away.
Figure 2:
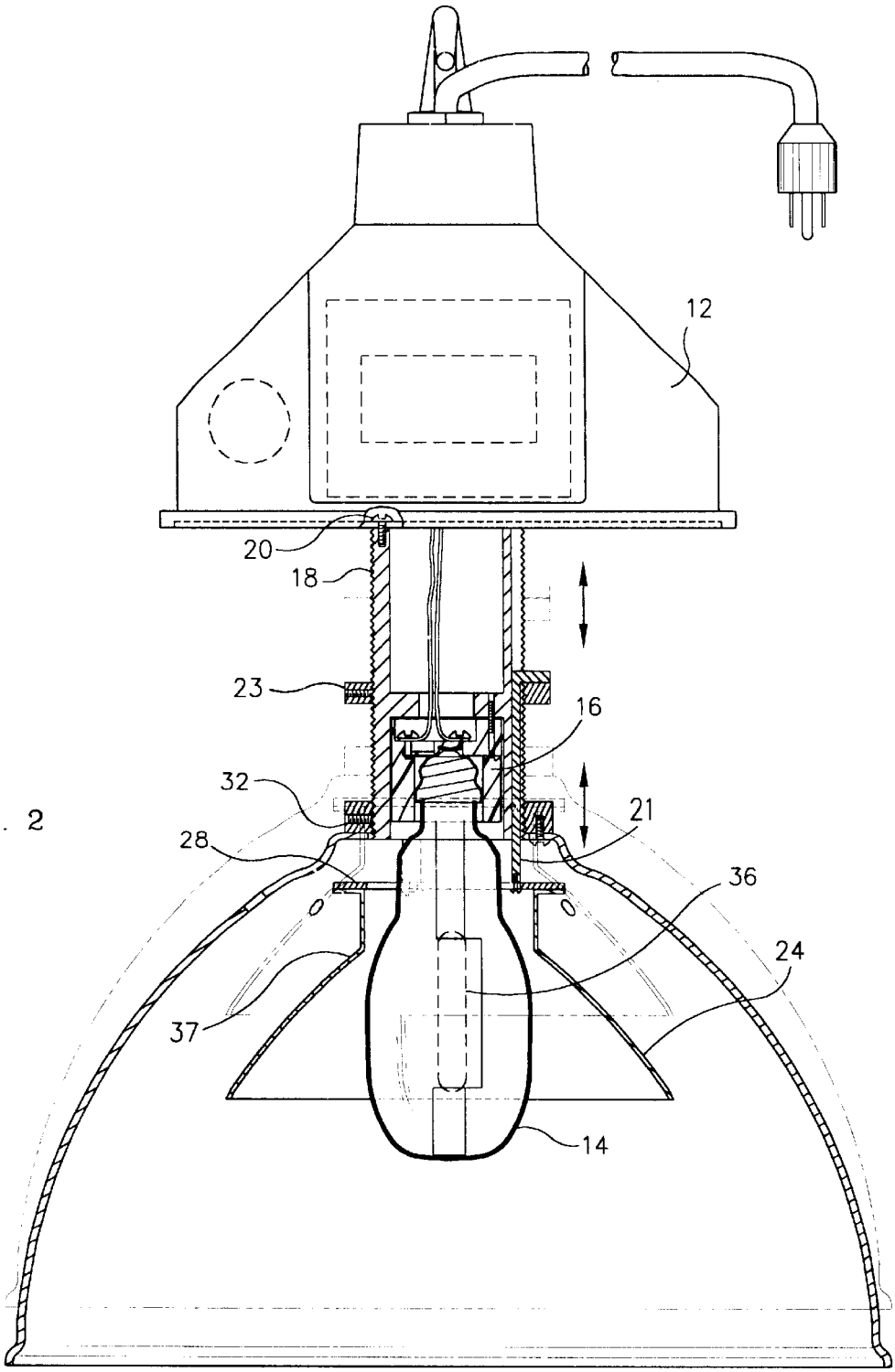
FIG. 2 is a partially cross sectional view with the outer reflector and inner reflector both partially broken away illustrating the subject invention when fully assembled.

In accordance with the present invention, there is shown in FIG. 1 a lighting fixture or luminaire generally designated as 10 having a housing or casing 12 which contains the ballast assembly or kit (not shown) and a high intensity discharge (H.I.D.) lamp 14 which is mounted substantially vertically with its base up into a lamp socket 16 which is shown in FIG. 2. The fixture 10 has a adjusting assembly generally designated as 17 attached to the bottom of the casing 12. The adjusting assembly includes a adjusting member 18 which is threaded and has a plurality of equidistantly spaced grooves 19 formed longitudinally therein. As shown in FIG. 2, the adjusting member 18 can be attached to the casing 12 by a plurality of screws 20 which engage a plurality of threaded holes (not shown) in the top of adjusting member 18. At least two equally spaced grooves should be formed in the adjusting member 18 in order to allow uniform adjustment of the inner reflector 24. However, it is preferred that three equally spaced grooves and three means for adjusting the outer reflector be used to prevent cocking and to insure uniform alignment and concentricity of the inner reflector relative to the lamp 14.

Each of the grooves 19 has an elongated member or rod 21 which rides within the groove 19. Each rod 21 has a flange or offset 22 at the top thereof which engages the top of a first or upper threaded adjusting ring 23. The bottom end of each rod 21 is connected to the inner reflector 24. One way of attaching the rod is by having a threaded hole (not shown) in the bottom of each rod 21 which is engaged by a screw 26 which passes through an opening 27 formed in the top 28 of the inner reflector. Many other ways can be utilized to secure the rods 21 to the inner reflector so that rotation of the ring 23 along the threaded adjusting member 18 moves the inner reflector up or down as desired.

The fixture includes an outer reflector 31 which has a second or lower threaded adjusting ring 32 mounted to the top thereof. The threaded ring 32 is secured to outer reflector 31 by screws, rivets, adhesive bonding, welding or any other way well known in the art. Optionally, the outer reflector can be integrally formed with a threaded top portion for engagement with the adjusting member 18.

The assembled fixture as shown in FIG. 2 illustrates that the inner reflector 24 is adjustable along the arc tube 36 of the H.I.D. lamp 14. This is accomplished by rotating the upper ring 23 along the adjusting member 18 to the desired location. This movement raises or lowers the rods 21 which are connected to the top 28 of the inner reflector. As the ring 23 moves up, the upper side of the ring engages the flanges 22 of the rods connected to the inner reflector 24. Very accurate and fine adjustment of the inner reflector 24 relative to the lamp 14 can be obtained. When the ring 23 moves down, the weight of the inner reflector keeps the flanges 22 in engagement with the ring 23 and the inner reflector 24 moves down.

Independently of the movement of the inner reflector 24, the lower ring 32 can be adjusted along the threaded adjusting member 18 to raise and lower the outer reflector 31. The rods 21 are adapted to be long enough to give the inner reflector a sufficient amount of adjustability, preferably within the range of having top of the curve 37 of the inner reflector 24 at its upper limit of travel approximately equal to or slightly above the top of the arc tube 36, and to have the top of the curve 37 of the inner reflector 24 at its lower limit of travel to be approximately near the midpoint of the arc tube 36. Even though this is the preferred range, it may be desirable to have even a larger amount of travel because there may be applications where you may want to position the inner reflector 24 even higher than the top of the arc tube 36 or below the midpoint of the arc tube.

The outer reflector also has a plurality of ventilation holes 38 formed therein to allow air to flow from the bottom of the fixture through the top of the fixture. When a fixture is used without a glass lens over the bottom of the fixture, air flows between the inner reflector 24 and outer reflector 31 and out the ventilation holes 38. This permits the fixture to remain relatively cool thereby keeping both the ballast and lamp cooler for longer life. It has been found in use that the temperature of the outer reflector is such that it can be touched without being burned due to the inherent cooling properties of this dual reflector structure. The air flow generated between the inner and outer reflector also facilitates in keeping both reflectors relatively clean. No ventilation holes are used in the outer reflector for dust proof applications.

To adjust the fixture after it is hung, the inner reflector 24 is typically first adjusted to provide a hot spot on the floor directly below the fixture. The inner reflector 24 is then raised by rotating the ring 23 to eliminate the hot spot and provide an even distribution of light. The outer reflector is then adjusted upwardly or downwardly by rotating ring 32 to get more spread or less spread as desired. The amount of spread desired is dependent upon the number of fixtures, the spacing between adjacent fixtures, and the height of the fixture from the floor. After the outer reflector is adjusted, it may be desirable to again adjust the inner reflector for optimum results. A plurality of set screws are provided in ring 23 to lock the ring when adjusted. The ring 23 is rotated so the set screws 25 are opposite the grooves 19 to lock the rods 21 which also eliminates any possible vibration therein during operation. A plurality of set screws 35 are also provided in the lower ring 32 for the same purpose.

It is to be noted that the adjustment of both the inner and the outer reflector can be accomplished without inserting the hand under the outer reflector or near the lamp. The adjusting assembly remains relatively cool to the touch and it is easy for the installer to make the adjustments. After the adjustments are made, set screws 25 and 35 in the upper and lower rings are tightened to secure the inner and outer reflector in the desired position and to prevent any vibration of the rods within the slots of the adjusting member.

While the subject invention is defined as a high bay fixture or luminaire, "high bay" is meant herein to cover any installation where the fixture is mounted high off the ground or floor. This would include such other applications as street lighting, parking lot lighting, building flood lighting, flood lights, low bays and sports lighting. Furthermore, while the fixtures shown do not have a lens or shield covering the bottom of the fixture, it is intended that this fixture can also be used for dust proof applications and other applications where a lens may be provided and the ventilation holes at the top of the outer reflector are eliminated.

While in most cases the outer reflectors are opaque and typically made of metal, the outer reflectors may also be translucent or transparent and made of acrylic or glass or other materials which allow light to pass therethrough. Such acrylic or glass reflectors may reflect no light or some light downwardly. Nevertheless, such reflectors are included within the definition of the term "outer reflector" as used herein. When acrylic or glass outer reflectors are used, the inner reflector is even more necessary and efficient in concentrating a substantial portion of light onto the floor while allowing the translucent or transparent outer reflector to pass all or some of the light therethrough. Additionally, while the outer reflector is shown herein as having a circular cross section, this is not necessary in all applications. For example, a square or rectangular outer reflector could be used with an inner reflector having a circular cross section. The inner reflector, however, is concentric with the center line of the outer reflector and the longitudinal axis of the lamp. Also, different shapes of inner reflectors could be used in accordance with the principles of this invention.

Figure 3:
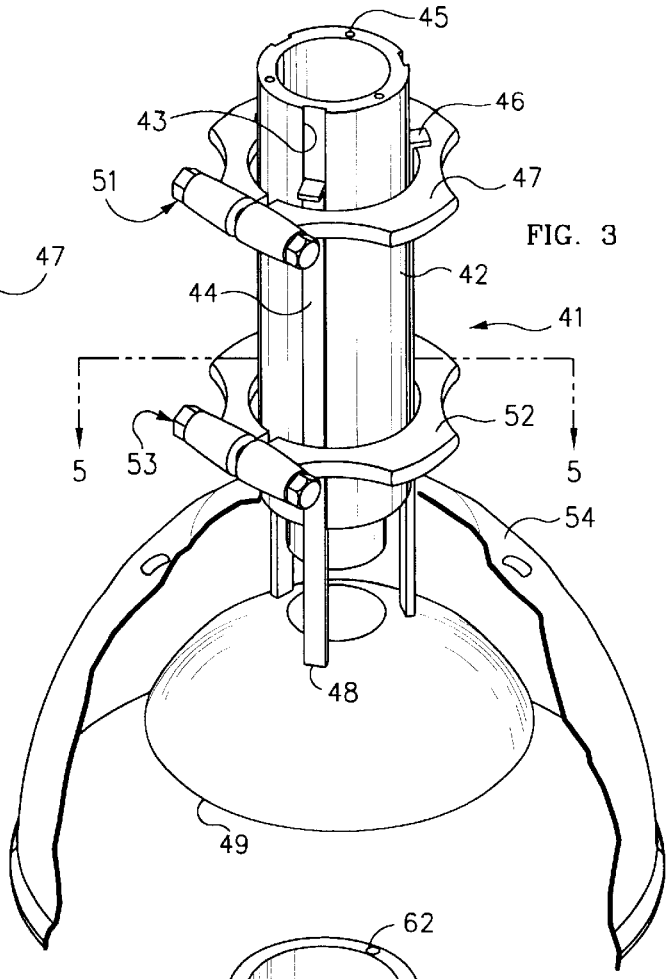
FIG. 3 is a perspective view of an alternative embodiment of the invention utilizing clamps instead of treaded members with the outer reflector partially broken away.
Figure 6:
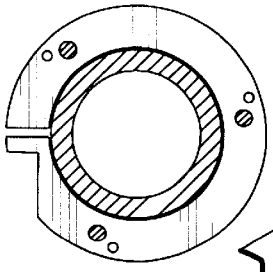
FIG. 6 is a cross sectional view along line 5—5 of FIG. 5 illustrating one of the clamps of the FIG. 5 embodiment.

Referring now to FIG. 3 there is shown an alternative embodiment of the subject invention in which an adjusting assembly generally designated as 41 includes an elongated hollow adjusting member 42. The adjusting member 42 has a plurality of threaded holes 45 in the top thereof to allow attachment to the casing (not shown). Adjusting member 42 has a plurality of equidistant grooves or slots 43 longitudinally formed therein. A minimum of two grooves should be utilized, however, three is preferred to keep the bottom plane of the inner reflector parallel to the bottom plane of the outer reflector during adjustment. A plurality of rods 44 are formed to freely slide within the grooves 43. Each rod 44 has a flange 46 formed on the upper end thereof which contacts the top of a clamp 47 which is mounted about the adjusting member 42. The bottom end of each rod 44 is connected at 48 to the inner reflector 49 by screws or otherwise. The clamp 47 is secured by any suitable fastening facilities such as the nut and bolt indicated at 51. In use, the clamp 47 is loosened at 51 and moved along the adjusting member 42 until the inner reflector 49 is at its desired position and the fastener assembly is tightened to secure the clamp 47 to the adjusting member 42. This locks the inner reflector 49 in the desired position. Another clamp 52 with a locking mechanism 53 is mounted to the outer reflector 54 by rivets, screws or otherwise. To adjust the outer reflector 54, the clamp 52 is loosened and moved up and down along the adjusting member 42 until it is at the desired position, at which point the locking mechanism 53 is tightened.

Figure 4:
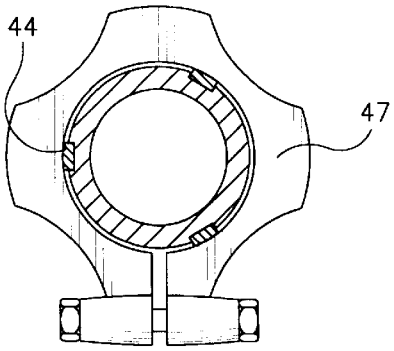
FIG. 4 is a cross sectional view along line 4—4 of FIG. 3 illustrating one of the clamps used in the FIG. 3 embodiment.

Referring to FIG. 4, it can be seen that the rods 44 are slightly thicker than the depth of the grooves 43 to allow the clamps 47 and 52 to securely grip the rods to prevent any further movement or vibration thereof.

Figure 5:
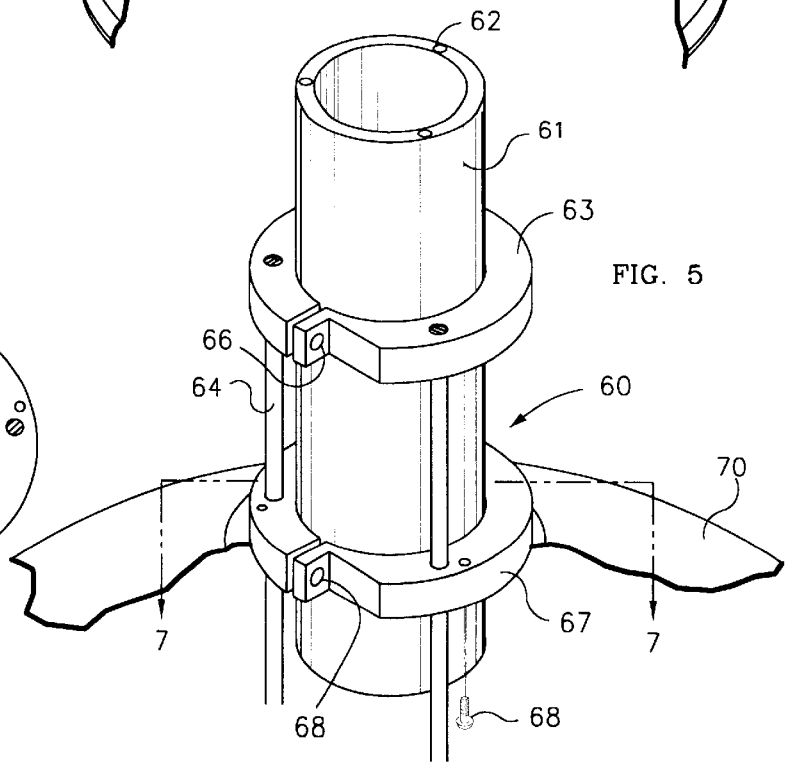
FIG. 5 is a perspective view of another alternative embodiment of the adjusting assembly of this invention.

Referring to FIG. 5, there is shown another alternative embodiment of the adjusting assembly which is generally designated as 60. Adjusting assembly 60 utilizes a smooth elongated adjusting member 61 which has a plurality of threaded holes 62 in its top end allowing attachment to the casing. An upper clamp 63 is used to adjust the inner reflector which is not shown. A plurality of rods 64 are connected to the upper clamp 63 and are rigidly mounted thereto by screws, welding, press fit or the like. The upper clamp 63 can be moved up and down along the adjusting member 61 to raise and lower the inner reflector to the desired position. When the desired position is reached, a screw is inserted into the aperture 66 to tighten the clamp and secure the clamp to the adjusting member 61. This locks in the position of the inner reflector. A lower clamp 67 has three holes formed therein to allow the rods 64 to move freely therethrough. The lower clamp 67 is secured to the top of the outer reflector 70 by screws 68 or some other fastening means as previously described. To adjust the outer reflector, the clamp 67 is loosened and moved up and down along the adjusting member 61 until the desired position is reached. Then a fastener is inserted into the aperture 68 and the clamp 67 is tightened along the adjusting member to lock in the position of the outer reflector.

While the adjusting member is shown herein as being tubular, it is intended that this not be limiting, for it is apparent that the adjusting member need not be circular in cross section, but could have a square, triangular, oval or any other cross-sectional shape so long as the clamps are adapted to fit over or otherwise engage the selected shape.

The subject invention allow the independent adjustment of the inner reflector and the outer reflector to maximize the intensity of the light at the working surface and to obtain the desired spread. Thus, the light reflected from the inner reflector, which covers a first predetermined area, is adjusted by the adjusting facilities for the inner reflector. Similarly, the light that is reflected from the outer reflector, namely the second predetermined area, is adjusted by using the outer reflector adjusting facilities. The subject fixtures can be used for a number of diverse applications from low ceilings to very high ceilings and can be adjusted to optimize its use for any particular application.

The invention also includes a dual reflector assembly which includes an outer reflector, an inner reflector, the adjusting assembly, and means for connecting the adjusting assembly to an existing casing for increasing the efficiency of the existing fixture and generating more light. Thus, where a 400 watt fixture is utilized and does not provide enough light, the adjusting assembly and inner and outer reflector can be attached thereto to generate more light. Similarly the dual reflector assembly can be connected to a 250 watt housing to provide light equivalent to a 400 watt fixture.

The invention also includes a retrofit kit for retrofitting conventional fixtures to become dual reflector fixtures. The retrofit kit may include a new ballast and a lamp so that for example, an existing 400 watt fixture can be retrofitted by changing the ballast assembly for the 400 watt lamp to the ballast assembly for a 250 watt lamp, adding the subject dual reflector adjusting assembly and adding a 250 watt lamp.

It has been found desirable to have the outer reflector be adjustable independently of the inner reflector and externally on the fixture. This allows the inner reflector to be adjusted first to obtain the desired focusing of light from the inner reflector and then secondly allow the outer reflector to be adjusted to obtain the desired spread. This facilitates the adjustment of the fixture after installation. To further facilitate the adjustment of a large number of fixtures in a facility, the adjusting member may be marked so that once an initial fixture is adjusted with the appropriate settings for the inner and the outer reflector, other fixtures may be adjusted on the ground before they are hung to minimize any need for separate adjustment after installation. The flexibility afforded by the independent adjustment of the inner reflector and the outer reflector, coupled with the efficiency provided by the use of the inner reflector, makes the fixture almost universal with respect to any number of different applications. Of course, there may be situations where smaller diameter or larger diameter reflectors may be utilized. The subject fixtures allow easy replacement of one reflector relative to another.

Although the present invention has been described in terms of certain preferred embodiments and exemplified with respect thereto, one skilled in the art will readily appreciate that various modifications, changes, omissions and substitutions may be made without departing from the spirit and scope thereof. It is intended that the present invention be limited solely by the scope of the following claims:

What is claimed is:

1. A retrofit kit for a gaseous discharge lamp fixture having a housing with a ballast assembly therein comprising:

an elongated tubular hollow adjusting member having at its upper end thereof means for connecting said adjusting member to a bottom of the housing;

a lamp socket mounted to a lower end of said adjusting member for receiving a gaseous discharge lamp;

means for electrically connecting said lamp socket to said ballast assembly;

an inner reflector; and means for connecting said inner reflector to said adjusting member and for moving said inner reflector to adjust said inner reflector relative to said lamp socket.

2. A retrofit kit as set forth in claim 1 wherein said adusting member is threaded and said means for connecting and moving said inner reflector comprises a threaded portion for engaging the threads of the adjusting member for adjustment relative thereto.

3. A retrofit kit as set forth in claim 2 wherein said means for connecting and moving said inner reflector comprises:

an internally threaded ring mounted for engagement with the threads of said adjusting member; and means for connecting said ring to said inner reflector so that said inner reflector is adjusted upon rotation of said ring about said adjusting member.

4. A retrofit kit as set forth in claim 1 wherein said adjusting member has a plurality of longitudinal grooves formed therein, and said means for connecting and moving said inner reflector comprises:

a plurality of elongated rods, each of which slides within one of said grooves, the lower end of each rod connected to the inner reflector; and means for moving said rods within said grooves and for locking said rods into any predetermined desired position.

5. A retrofit kit as set forth in claim 1 wherein said adjusting member has a plurality of equidistant longitudinal grooves formed therein, and said means for connecting and moving said inner reflector comprises:

a plurality of elongated rods, each of which slides within one of said grooves, a lower end of each rod connected to the inner reflector, and an upper end of each rod having a flange formed therein; and an internally threaded ring mounted on said threaded adjusting member for engagement with the flanges of said rods to adjust said inner reflector.

6. A retrofit kit as set forth in claim 1 wherein said means for connecting and moving said inner reflector comprises a clamp having an opening therein for receiving the adjusting member and means for connecting said clamp to said inner reflector so that said clamp can be positioned to adjust the inner reflector relative to said lamp socket.

7. A retrofit kit as set forth in claim 6 comprising means for tightening said clamp to said adjusting member to lock said inner reflector in the desired position.

8. A retrofit kit as set forth in claim 6 wherein said means for connecting said clamp to said inner reflector comprises:

a plurality of elongated rods, each rod having its upper end connected to said clamp and its lower end connected to said inner reflector.

9. An inner reflector adjusting assembly for a lighting system which includes a housing, an outer reflector and a lamp comprising:

an elongated tubular adjusting member having one end thereof adapted to connect to the bottom of the housing;

an inner reflector;

a ring mounted for movement about said tubular adjusting member; and means for connecting said ring to the inner reflector for adjusting the inner reflector relative to said tubular adjusting member.

10. An adjusting assembly as set forth in claim 9 wherein said means for connecting said ring to the inner reflector comprises:

a plurality of elongated slide members, each slide member having an upper end engaged with the ring and a lower end adapted to connect to the inner reflector so that movement of the ring about said adjusting member moves the inner reflector relative to said adjusting member.

11. An adjusting assembly as set forth in claim 9 wherein said tubular adjusting member is threaded and said ring is internally threaded for engagement with said tubular adjusting member.

12. An adjusting assembly for a dual reflector lighting system which includes a ballast housing with a ballast assembly therein, an outer reflector, and a lamp comprising:

an elongated tubular adjusting member having a passageway longitudinally therethrough, the upper end of said adjusting member adapted to connect to a bottom of said housing, the lower end of said adjusting member having a recess therein for receiving a lamp socket having a pair of wires connected thereto which extends through said passageway so that the free ends thereof can be connected to the ballast assembly;

an inner reflector; and means for connecting the inner reflector to said adjusting member and for moving said inner reflector relative to said adjusting member.

13. An adjusting assembly as set forth in claim 12 wherein:

said tubular adjusting member is externally threaded; and said means for connecting the inner reflector comprises an internally threaded ring mounted for rotation about said threaded tubular adjusting member and means for connecting said ring to said inner reflector so that said inner reflector is adjusted relative to said adjusting member upon rotation of said ring about said adjusting member.

14. An adjusting assembly as set forth in claim 13 wherein the tubular adjusting member has a plurality of longitudinal grooves formed therein and said means for connecting said ring to said inner reflector comprises a plurality of elongated slide members, each of which slides within one of said grooves, a lower end of each slide member adapted to be connected to the inner reflector, and the upper end of each slide member having a flange formed therein for engagement with the ring.

* * * * *